US006050273A

United States Patent [19]

Lhuisset

[11] Patent Number: 6,050,273

[45] Date of Patent: Apr. 18, 2000

[54] MASCARA BRUSH

[75] Inventor: Francois Lhuisset, Montgeron, France

[73] Assignee: Lvmh Recherche, Nanterre, France

[21] Appl. No.: 09/043,332

[22] PCT Filed: Sep. 12, 1996

[86] PCT No.: PCT/FR96/01407

§ 371 Date: Oct. 22, 1998

§ 102(e) Date: Oct. 22, 1998

[87] PCT Pub. No.: WO97/09905

PCT Pub. Date: Mar. 20, 1997

[30] Foreign Application Priority Data

Sep. 13, 1995 [FR] France ..... 95/10724

[51] Int. Cl.[7] ..... A45D 40/24; A45D 40/26; A46B 11/00

[52] U.S. Cl. ..... 132/317; 132/320; 401/129; 401/140

[58] Field of Search ..... 132/317, 308, 132/320; 433/147, 141; 15/167.1, 167.2; 401/129, 140, 6

[56] References Cited

U.S. PATENT DOCUMENTS

| | | | |
|---|---|---|---|
| D. 100,558 | 7/1936 | Hachman | 15/167.1 |
| D. 109,472 | 5/1938 | Clarren | 15/167.1 |
| D. 121,437 | 7/1940 | Hadden | 15/167.1 |
| 1,639,880 | 8/1927 | Butler | 15/167.1 |
| 2,229,664 | 1/1941 | Meeske | 15/167.1 |
| 4,222,677 | 9/1980 | Cervantes | 401/129 |
| 4,648,416 | 3/1987 | Kilman et al. | 15/167.1 |
| 5,242,301 | 9/1993 | Hickey et al. | 433/141 |
| 5,511,277 | 4/1996 | Simonds | 15/167.1 |
| 5,522,109 | 6/1996 | Chan | 15/106 |
| 5,881,421 | 3/1999 | Ducharme | 15/106 |

*Primary Examiner*—John J. Wilson
*Assistant Examiner*—Robyn Kieu Doan
*Attorney, Agent, or Firm*—Leydig, Voit & Mayer, Ltd.

[57] ABSTRACT

A brush includes a mascara applicator and a stem with a grip, the stem having first and second ends substantially aligned with each other along a common axis, and an intermediate non-rectilinear portion connecting the first and second ends, the intermediate non-rectilinear portion having an offset shape protruding in a first direction from the common axis, the mascara applicator being attached to the first end and protruding from the common axis in a second direction substantially opposite the first direction, and the grip being attached to the second end of the stem.

6 Claims, 2 Drawing Sheets

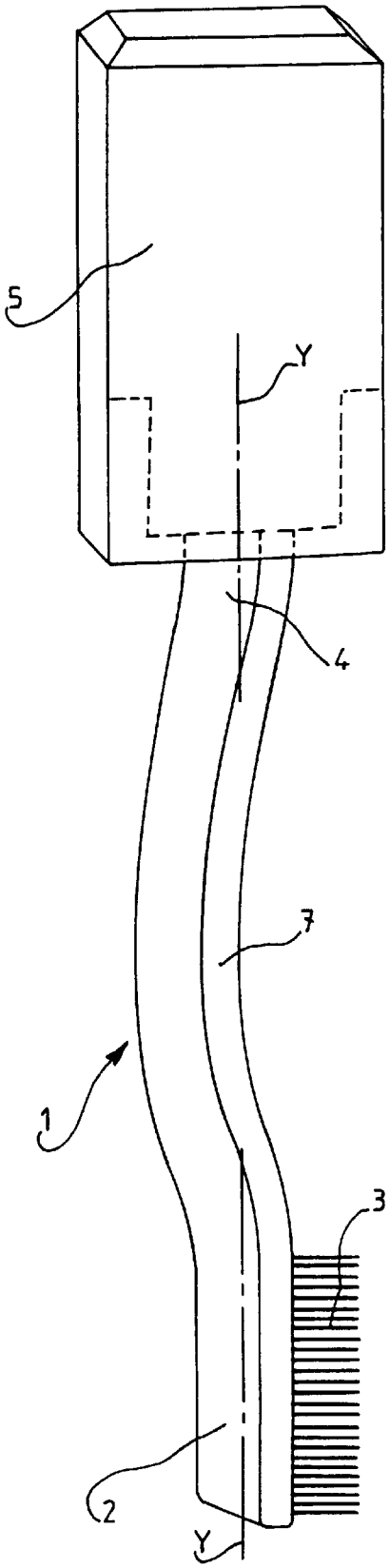
Fig. 1
Fig. 2
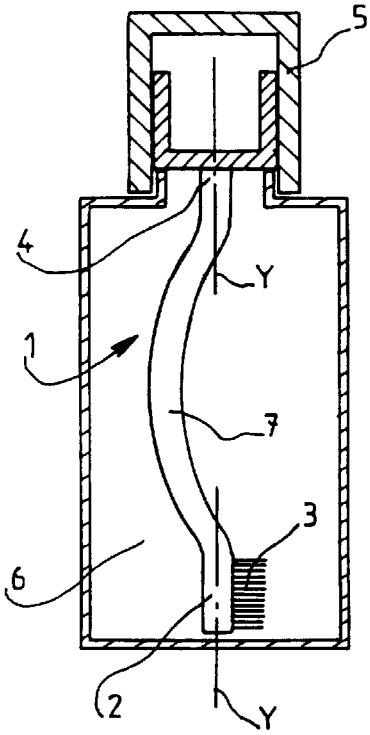
Fig. 3
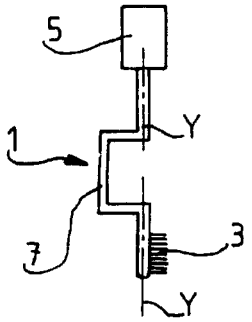
Fig. 4
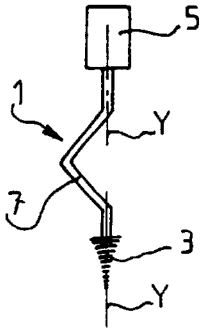

MASCARA BRUSH

The present invention has essentially as its subject a brush of special shape for the application of mascara.

FIELD OF THE INVENTION

Until now, the mascara brush stems always were rectilinear and this was an inconvenience.

BACKGROUND OF THE INVENTION

In effect, unless being very deft, it was difficult with these brushes to pass round the anatomic obstacles of the face located about the eyelashes to be made up such in particular as the cheek bones, the malar bone and the root of the nose.

Thus owing to the fact of the rectilinear shape of the stem of the brush and of the presence of these obstacles, the bristles could not present themselves in a substantially parallel relation to the eyelashes to be made up, so that it resulted therefrom an imperfect and/or irregular make-up.

At last it should be noted that the stem of the brush still due to the fact of its rectilinear shape could hit one part of the face upon the presentation of the brush in the vicinity of the eyelashes, which could cause the deposit of mascara upon undesired zones or at the least notably hinder the make-up operation.

Therefore, the present invention has as its object to remedy in particular these inconveniences by proposing a brush which permits to escape the projecting portions of the face near the zone to be made up and to provide a quasi-perfect make-up in particular of the eyelashes and this even if the skill of the female user of the brush is somewhat defective.

For that purpose, the invention has as its subject a brush for the application of mascara on in particular the eyelashes and comprising a stem provided at one of its ends with one or several tufts of bristles having any configuration, characterized in that the said stem exhibits a non-rectilinear shape in order that it may pass round the anatomic obstacles of the face located in the vicinity of the zone to be made up.

SUMMARY OF THE INVENTION

According to another characteristic of the invention, this brush comprises a stem portion with an offset shape between both ends of the said stem which extend along substantially a same axis.

The non-rectilinear or offset shape of the stem may be an arcuate or curved shape.

According to another embodiment, the non-rectilinear or offset shape of the stem is a crenel or V-shape.

The brush according to this invention is further characterized in that the end of the stem opposite to that carrying the tuft of bristles is made fast to a closure cap for a mascara container.

According to another characteristic of the invention, the stem comprises a pivotal connection about an axis perpendicular to the plane defined by the geometric shape of the said stem, which pivotal connection is located in the vicinity of the end carrying the tuft of bristles.

But further characteristics and advantages of the invention will appear more clearly in the detailed description which follows and refers to the attached drawings given by way of example only and in which:

BRIEF DESCRIPTION OF THE DRAWINGS

FIG. 1 is a perspective view of a brush according to the invention and made fast to a closure cap for a mascara container;

FIG. 2 is a view in axial section of this container closed by the cap carrying the brush;

FIGS. 3 and 4 diagrammatically illustrate in elevation two other particular shapes, respectively, of a brush stem;

Figure 5:
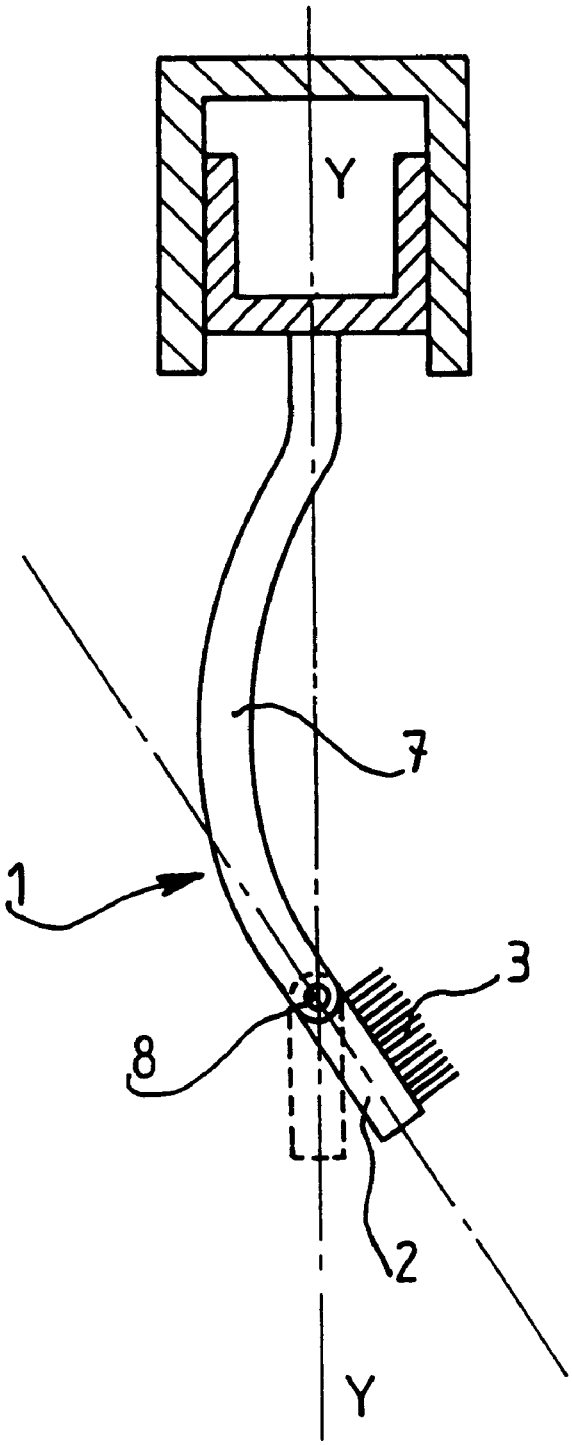
FIG. 5 illustrates in elevation and in section another embodiment with a pivotal connection of the brush to the end of the stem.

One sees on the figures a brush for the application of mascara, consisting of a stem 1 one 2 of the ends of which carries several tufts of bristles 3 and the other end 4 of which is made fast to a closure cap 5 for a mascara container or bottle 6.

The end 4 of the brush could without leaving the invention, quite simply constitute a handle for the gripping of the brush, i.e. it may not be made fast to the closure cap 5.

The stem 1 of the brush exhibits a non-rectilinear shape as one sees it well on the figures so as to be able to pass round the anatomic obstacles of the face such in particular as the cheek bones, the malar bone and the root of the nose.

According to one preferred embodiment, one portion 7 only of the stem 1 is deformed or offset between the ends 2 and 4 of the stem, these two ends extending substantially along a same axis designated at Y on the figures.

As one sees it clearly on FIGS. 1 and 2, the non-rectilinear or offset portion 7 of the stem 1 exhibits an arcuate or curved shape.

In the embodiment visible on FIGS. 3 and 4, one sees that the deformed portion 7 of the stem 1 exhibits a crenel or V-shape.

The radius of curvature of the arcuate portion 7 of the stem 1 in the case of FIGS. 1 and 2 may of course be any one as well as in the case of FIGS. 3 and 4, the portion 7 of the stem 1 may have other shapes than those shown on these figures and which quite obviously should be compatible with the container 6 in order to permit the insertion or the extraction of the brush.

Referring now to FIG. 5, one sees that the stem 1 is provided with a pivotal connection about an axis 8 which is perpendicular to the plane defined by the geometric and arcuate shape of the said stem. This pivotal connection is located in the vicinity of the end 2 carrying the tufts of bristles 3.

Thus, the female user could direct the applicator head of the brush in the most suitable direction for the make-up according to the operation effected. Otherwise said, the pivotal connection 8 will permit to ensure for the rows of bristles 3 a position substantially parallel to the eyelashes to be made up.

One has therefore provided according to the invention a mascara brush comprising a stem forming a handle or being made fast to a closure cap, this stem exhibiting any arcuate or offset shape to thus avoid to hit the projecting parts of the face in the vicinity of the zone to be made up and for providing a regular and precise make-up in particular of the eyelashes and this even if the female user is an inexperienced person.

The invention is of course not at all limited to the embodiments described and illustrated which have been given by way of example only.

Thus the tuft of bristles carried by one end of the brush may assume any geometric shape or even be replaced with another applicator device such as a foam. Likewise the material constituting the stem of the brush may be any one too.

This means that the invention comprises all the technical equivalents of the means described as well as their combinations if the latter fall within the scope of the claims which follow.

What is claimed is:

1. A brush comprising:

a mascara applicator; and a stem with a grip, the stem having first and second ends substantially aligned with each other along a common axis, and an intermediate non-rectilinear portion connecting the first and second ends, said intermediate non-rectilinear portion having an offset shape protruding in a first direction from the common axis, the mascara applicator being attached to the first end of said stem and protruding from the common axis in a second direction substantially opposite the first direction, and said grip being attached to the second end of said stem.

2. The brush according to claim 1 wherein said intermediate non-rectilinear portion of said stem has an arcuate shape.

3. The brush according to claim 1 wherein said intermediate non-rectilinear portion of said stem has a crenel shape.

4. The brush according to claim 1 wherein said intermediate non-rectilinear portion of said stem has a V-shape.

5. The brush according to claim 1 wherein said grip is a closure cap for a mascara container.

6. The brush according to claim 1 wherein the first end of said stem is pivotable about an axis extending perpendicular to a plane including the first and second ends of said stem.

* * * * *